United States Patent [19]

Comeau

[11] Patent Number: 4,519,433

[45] Date of Patent: May 28, 1985

[54] DRIVE SPROCKET FOR TRAVERSE ROD

[75] Inventor: Paul E. Comeau, Warwick, R.I.

[73] Assignee: Kenney Manufacturing Company, Warwick, R.I.

[21] Appl. No.: 648,054

[22] Filed: Sep. 6, 1984

Related U.S. Application Data

[63] Continuation of Ser. No. 460,646, Jan. 24, 1983.

[51] Int. Cl.[3] ..... A47H 1/08; A47H 5/02

[52] U.S. Cl. ..... 160/126; 160/330; 474/153

[58] Field of Search ..... 160/126

[56] References Cited

U.S. PATENT DOCUMENTS

| | | | |
|---|---|---|---|
| 394,335 | 12/1888 | Chase | 474/162 |
| 457,420 | 8/1891 | Neacy | 474/162 |
| 3,577,794 | 5/1971 | Kerfoot | 474/204 |
| 3,642,120 | 2/1972 | Duhan | 474/153 |
| 4,102,381 | 7/1978 | Bratschi | 160/168 R |
| 4,148,225 | 4/1979 | Redmond, Jr. | 474/152 |

FOREIGN PATENT DOCUMENTS

| | | | |
|---|---|---|---|
| 17687 | of 1895 | United Kingdom | 474/162 |
| 10903 | of 1897 | United Kingdom | 474/152 |

*Primary Examiner*—Peter M. Caun
*Assistant Examiner*—Cherney S. Lieberman
*Attorney, Agent, or Firm*—Robert B. Russell

[57] ABSTRACT

Adjustable drapery traverse rods provided with a motor driven means for moving master carriers utilize a uniformly perforated drive tape and sprocket combination. Because of the perforations in the drive tape, the tape does not form a smooth curve when bent. The drive sprocket is thus adapted to allow the drive tape to lie flush against the sprocket as the tape passes over the sprocket over a wide range of tape tensions and, thereby, to drive the tape smoothly and noiselessly.

4 Claims, 6 Drawing Figures

DRIVE SPROCKET FOR TRAVERSE ROD

This application is a continuation of application Ser. No. 460,646, filed Jan. 24, 1983.

FIELD OF THE INVENTION

This invention relates to drapery hardware and more particularly to the drive means for motor-driven traverse rods. Still more particularly, it relates to a drive tape and sprocket combination for such rods.

BACKGROUND OF THE INVENTION

Motor-driven traverse rods have been in use for many years. Initially, these motor-driven traverse rods were expensive and difficult to install. Recent innovations have now made these devices affordable and suitable for consumer installation.

These new traverse rod assemblies comprise adjustable telescoping rods upon which are mounted first and second master carriers and numerous idler carriers. The master carriers are driven by a flexible, perforated, relatively non-stretchable drive tape which extends from end-to-end within the rod in the form of a loop. Pulleys are provided at each end of the rod and the tape loop passes around them with the ends of the loop joined at the first master carrier. At one end of the rod the tape also passes around a toothed sprocket, with the teeth of the sprocket fitting, in positive driving relation, into the perforations in the tape. The sprocket is driven from the outside by a motor or other drive mechanism to control the position of the master carriers. Adjustable means, accessible from the outside of the rod, are provided for securing the ends of the tape loop to the first carrier so that the length of the rod can be adjusted, and, thereafter, all substantial slack can be removed from the tape loop. Within the rod, the other leg of the tape loop is secured to the second master carrier at the point on the tape loop which corresponds to the fully opened position of the second master carrier when the first master carrier is in the fully opened position.

By the nature of the system, fine adjustments of the drive tape are not easily made. As a result, it is not always possible to have the drive tape fit snugly over the toothed sprocket.

Also, the drive tape bends more easily at the areas where there are perforations than at the areas between the perforations. Thus, when the tape is bent, as when it passes around a circular drive sprocket, the tape unless it is heavily tensioned, does not form a smooth curved surface, but rather appears more like a series of short but relatively straight sections hinged together. A profile of the tape as it passes over a conventional sprocket is shown in FIG. 3 and illustrates this effect.

Because of the non-circular bending characteristic of the drive tape, when the tape-sprocket assembly is not under high tension the tape will not lie flush against the portions of a conventional sprocket between the sprocket teeth and an unpleasant rattling noise in operation results. Not only is the noise unpleasant but undersired wear on the tape and sprocket result.

A basic objective of this invention is to provide an inexpensive means for allowing the perforated tape to fit smoothly over the toothed sprocket, so as to eliminate the rattle and wear just described. A more specific objective is to provide a toothed sprocket that is adapted to better fit the drive tape as the tape passes over the sprocket.

BRIEF DESCRIPTION OF THE INVENTION

In the accomplishment of these and other objects of the invention in a preferred embodiment thereof, the sprocket used to drive the drive tape is specifically shaped to conform to the drive tape when the tape is lightly tensioned.

The preferred embodiment of the invention is adapted for use with a conventional traverse rod that utilizes a drive tape and sprocket combination to move the master carriers. At each end of the traverse rod is a pulley system. The drive tape, which forms a continuous loop within the rod, passes over each pulley and is attached to the master carriers. The tape is flexible and essentially non-stretchable and is perforated with uniformly spaced holes through which the teeth of a drive sprocket fit. The drive sprocket is located at one end of the traverse rod and is driven by a motor or other drive mechanism to control the position of the master carriers.

As described in the previous section, the tape bends more easily at the perforations and thus does not form a smooth uniform curve when it is bent. As a result, unless it is heavily tensioned it does not fit evenly against a conventional drive sprocket. To solve the problem created thereby, the curved sections between the sprocket teeth of the outer circumference of the drive sprocket are interrupted by a flat portion in the center of the curved section. Thus, the sprocket appears somewhat like a multisided geometric figure, such as an octagon, except that the actual sprocket is more rounded with no distinct angles on its circumference.

With this new shape, even when lightly tensioned, the sprocket conforms to the shape of the tape and rattling noise and wear associated therewith are virtually eliminated.

BRIEF DESCRIPTION OF THE DRAWINGS

A preferred embodiment of the invention selected for purposes of illustration only is depicted in the accompanying drawings in which.

DETAILED DESCRIPTION OF THE INVENTION

Figure 6:
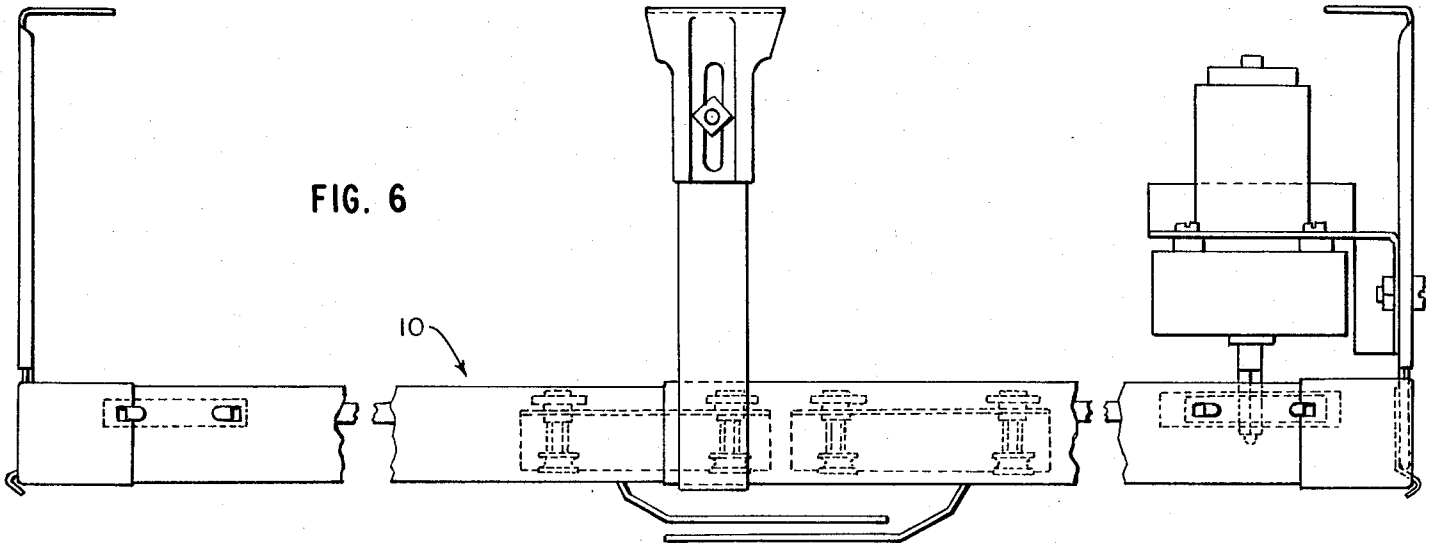
FIG. 6 is a top elevational view of the traverse rod of FIG. 5.
Figure 5:
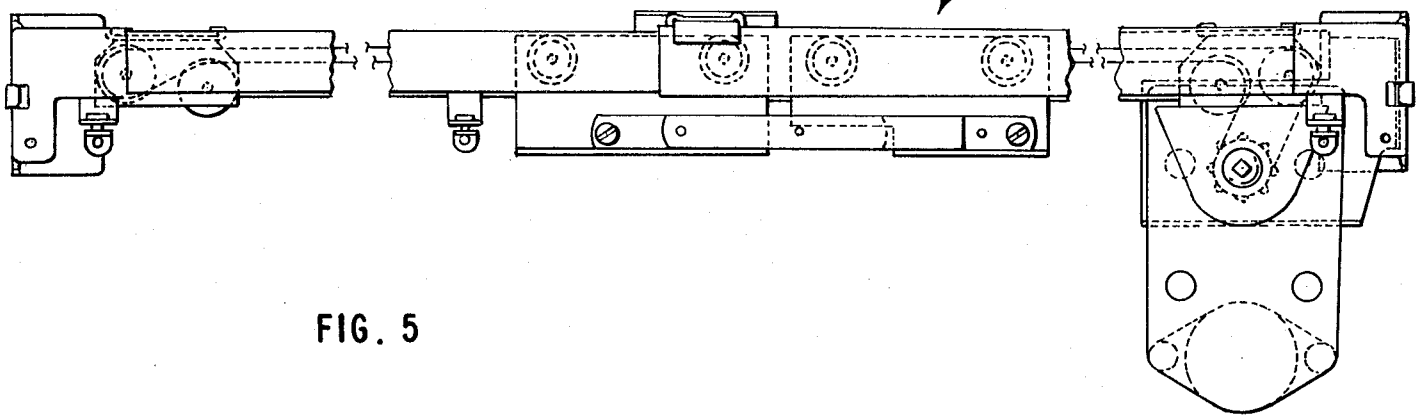
FIG. 5 is a front elevational view of a traverse rod having the tape-drive, sprocket, and master carrier combination of the present invention mounted thereon.

The preferred embodiment of the invention herein shown is adapted for use with a conventional traverse rod curtain assembly indicated generally at 10 in FIGS. 5 and 6. Pulleys 30 are located at each end of the traverse rod.

Figure 1:
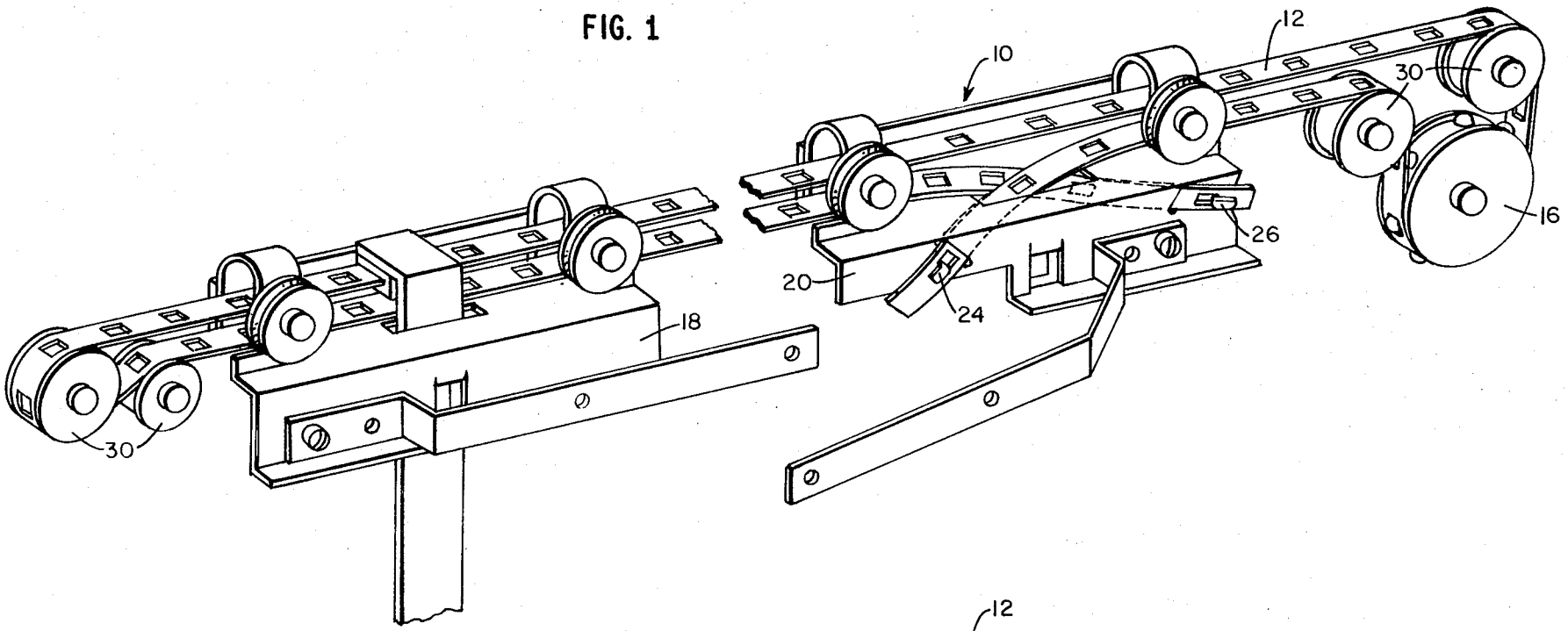
FIG. 1 is a perspective view showing the operative components of the tape drive and master carrier combination.
Figure 2:
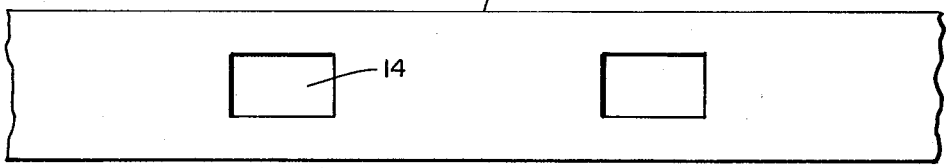
FIG. 2 is a plan view of the flexible, uniformly perforated drive tape.

The drive tape 12 passes over the pulleys 30 and around the drive sprocket 16 to form an endless loop. Attached to the tape are master carriers 18 and 20. As illustrated in FIG. 2, the tape has uniformly spaced perforations 14 which fit in positive driving relation with the teeth 22 of sprocket 16. The sprocket 16 is driven from the outside by a motor or other drive mechanism (not shown) to control the position of the master carriers 18 and 20.

The length of the tape loop is adjusted where the tape is attached to master carrier 20. Prongs 24 and 26 located on carrier 20 hook through the perforations in the drive tape. Since the perforations are ⅜" apart, and the tape passes over pulleys at each end, the adjustment of the length of the loop is in increments of 3/16". The importance of the tape adjustment will become more apparent in the following paragraphs.

Figure 3:
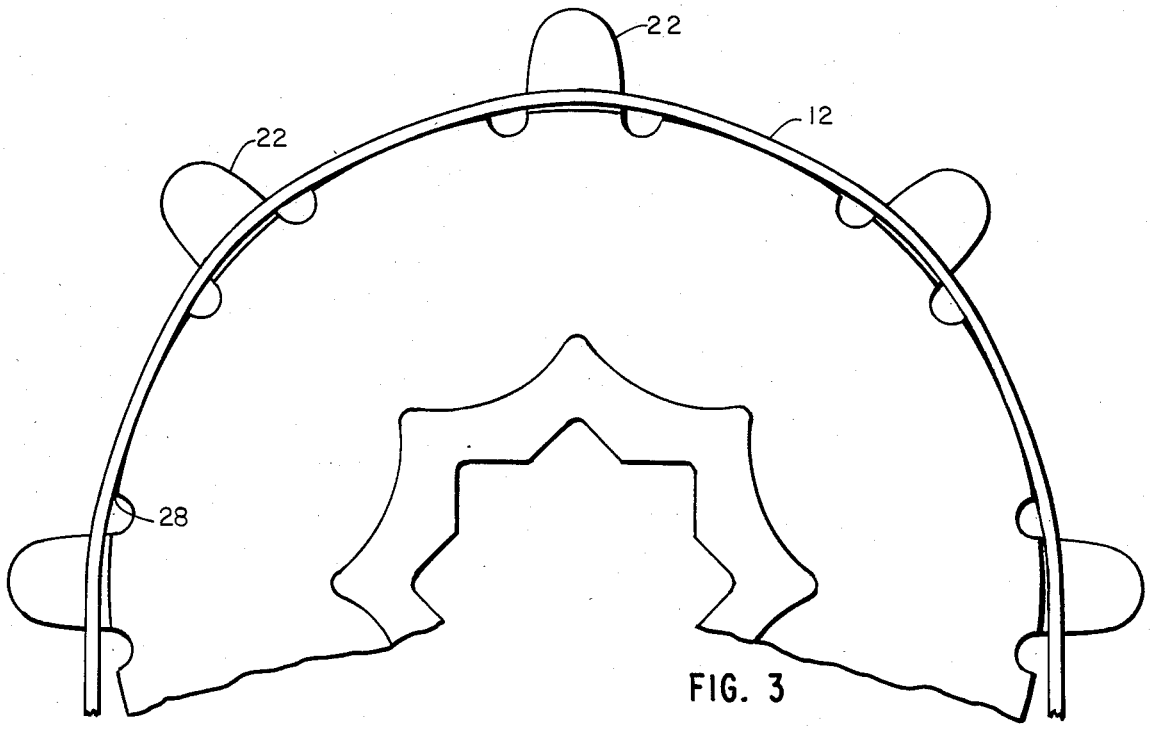
FIG. 3 is a side view of the drive tape passing over a conventional drive sprocket.

Because the tape is weaker and more flexible in the areas where the perforations are located, the tape does not bend in a uniform manner. Thus, when the tape passes around a conventional drive sprocket under light tension, most of the bending in the tape occurs at the perforations, and the areas between the perforations are relatively straight. This phenomenon is shown in FIG. 3 in an exaggerated illustration. It can be seen that the tape is bending more noticeably at its perforations (indicated by the sprocket teeth). As a result of this, gaps occur at 28 in FIG. 3 between the sprocket and the drive tape. These gaps cause excessive rattling noises and premature wear.

Figure 4:
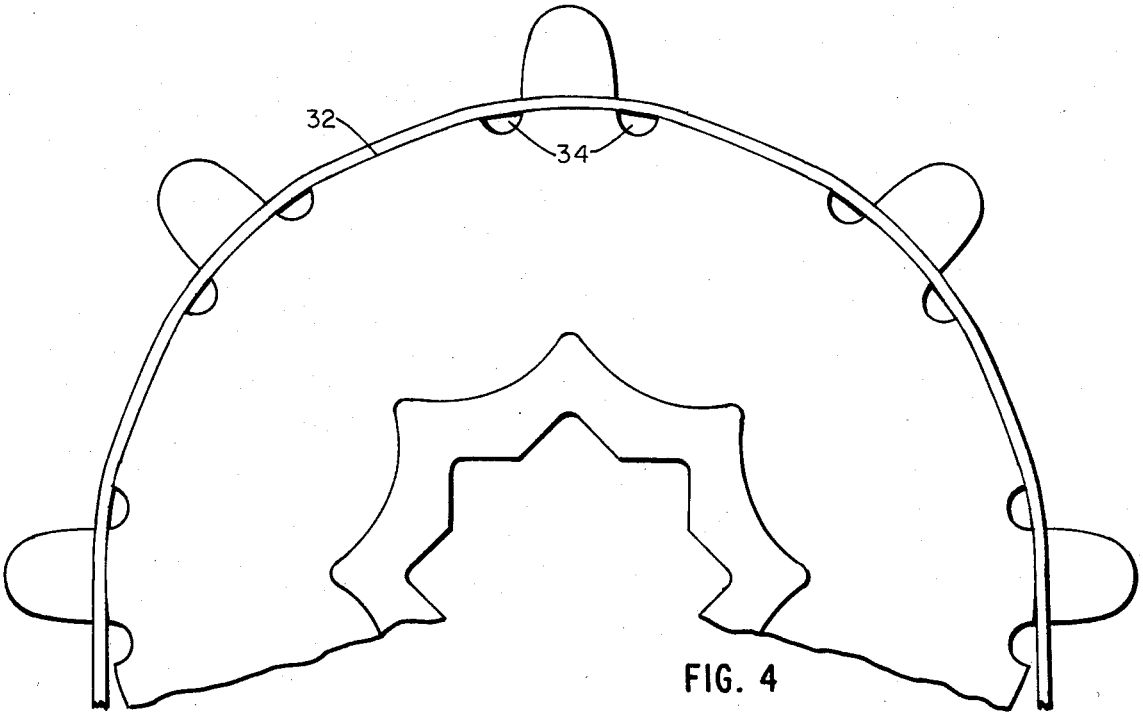
FIG. 4 is a side view of the drive tape passing over the inventive drive sprocket which is adapted to better fit the drive tape under light tension.

If the tension on the drive tape is high, the tape can be pulled tight against the sprocket, thus avoiding the above mentioned problems, but with adjustment increments of only 3/16" it is not always possible to achieve such high tension. To avoid these gaps and resulting noise and wear the preferred embodiment of the present invention utilizes a drive sprocket designed so as to conform to the shape of the tape as it passes over the sprocket even under light tension. The novel design is illustrated by sprocket 16 in FIG. 4. By light tension, it is meant sufficient tension only to avoid looseness or play during the reversal of direction of the tape.

By flattening the traditionally curved surface of the sprocket at points 32, midway between the sprocket teeth, the tape is able to lie flush against the sprocket under light tension, and excess noises and wear are prevented at varying tensions of the drive tape. Although the tape is relatively non-stretchable, it does stretch in tape lengths corresponding to the loop within a curtain rod under varying tension by as much as the 3/16" increments of adjustment of length of the points of attachment to the first master carrier. Thus the tape will always fit the sprocket snugly despite the lack of infinite adjustment of the tape to the corner. In this manner the rod, the tape and the sprocket cooperate to provide a smooth running and noiseless device. The exact shape of the sprocket can be varied depending upon the physical qualities of the drive tape used, although all embodiments will involve a certain amount of flattening in the area of the sprocket's circumference between the sprocket teeth. In addition, depressions 34 located on each side of the sprocket teeth help the drive tape to lie flat against the sprocket.

In a particular embodiment of this invention, a drive sprocket with 8 teeth spaced evenly at 45° angles is used. The diameter of the sprocket (not measuring the teeth) is about 0.8 inches, the teeth being 0.08 inches wide. The flattened portions midway between the teeth are 0.082 inches.

Since various modifications of the invention will now be obvious to those skilled in the art, it is not our intention to confine the invention to the precise form herein shown, but rather to limit in terms of the appended claims.

I claim:

1. A tape-drive, sprocket, and master carrier combination for traverse rods for curtains comprising:

(a) a pair of hollow telescoping longitudinally adjustable traverse rod sections;

(b) a pair of master carriers mounted to slide within said rod sections;

(c) a length of flexible relatively non-stretchable drive tape for moving said master carriers;

(d) uniformly spaced perforations through said tape forming weakened portions in said tape adjacent to said perforations whereby when said tape is bent in the absence of tension, it bends primarily at said weakened portions;

(e) pulley means at each end of said traverse rod, over which said drive tape passes;

(f) means incrementally adjusting the length of said tape to conform substantially to the length of said rod comprising means for securing the ends of said length of tape to one said master carrier, including a detent at each end of said one master carrier fitting into one said perforation at each end of said tape, to form an endless loop within said traverse rod;

(g) a toothed drive sprocket for driving said tape with the teeth of said sprocket fitting in positive driving relation fully into at least two consecutive perforations in said tape, with said tape bending over said sprocket primarily at said weakened portions, with the tape resting on the surface of said sprocket therebetween, and at least a portion of the curved section of the outer circumference of the sprocket between each of the sprocket teeth being flat in the center of the curved section to conform to the natural bend of the drive tape as said tape passes over the sprocket under light tension, whereby said drive tape conforms to said sprocket and runs noiselessly despite varying degrees of tension on the tape.

2. The tape-drive, sprocket, and master carrier combination defined in claim 1, wherein there is a slight depression located on each side of every sprocket tooth.

3. The tape-drive, sprocket, and master carrier combination defined in claim 1, wherein the entire portion of the outer circumference of the sprocket, between each sprocket tooth, is flat.

4. The tape-drive, sprocket, and master carrier combination defined in claim 3, wherein there is a slight depression located on each side of every sprocket tooth.

* * * * *